US008054224B1

(12) United States Patent
de La Chapelle et al.

(10) Patent No.: US 8,054,224 B1
(45) Date of Patent: Nov. 8, 2011

(54) PHASED ARRAY ANTENNA USING IDENTICAL ANTENNA CELLS

(75) Inventors: Michael de La Chapelle, Bellevue, WA (US); Douglas A. Pietila, Puyallup, WA (US); Anthony D. Monk, Seattle, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 12/913,093

(22) Filed: Oct. 27, 2010

(51) Int. Cl.
*H01Q 3/00* (2006.01)

(52) U.S. Cl. ..... 342/372

(58) Field of Classification Search ..... 342/372
See application file for complete search history.

(56) References Cited

U.S. PATENT DOCUMENTS 5,952,964 A * 9/1999 Chan ..... 342/368
6,388,631 B1 * 5/2002 Livingston et al. ..... 343/767
6,642,889 B1 * 11/2003 McGrath ..... 343/700 MS
6,774,848 B2 8/2004 Wright
6,795,018 B2 * 9/2004 Guo ..... 342/372
6,972,716 B2 12/2005 Davis et al.
7,098,848 B2 * 8/2006 Ksienski et al. ..... 342/372
7,317,427 B2 * 1/2008 Pauplis et al. ..... 343/853
7,348,929 B2 * 3/2008 Phelan et al. ..... 343/844

OTHER PUBLICATIONS

G. H. Walker, "Thinned Arrays Using Amplitude Sharing", 9th European Microwave Conference, Oct. 1979, pp. 159-163.*
Herd, J.S. and A.J. Fenn, "Design Considerations for Space-Based Radar Phased Arrays", IEEE Microwave Symposium Digest, MTT-S International, Jun. 12-17, 2005, pp. 1631-1634.*

* cited by examiner

*Primary Examiner* — Thomas Tarcza
*Assistant Examiner* — Frank McGue
(74) *Attorney, Agent, or Firm* — Yee & Associates, P.C.

(57) ABSTRACT

A method and apparatus for creating an antenna system. A configuration for a plurality of antenna cells is selected for an antenna in the antenna system. Each antenna cell in the plurality of antenna cells comprises a plurality of antenna elements having a symmetric arrangement. A portion of antenna elements in the plurality of antenna elements for each antenna cell in the plurality of antenna cells on a substrate is selected to transmit electromagnetic waves.

25 Claims, 5 Drawing Sheets

PHASED ARRAY ANTENNA USING IDENTICAL ANTENNA CELLS

BACKGROUND INFORMATION

1. Field

The present disclosure relates generally to antennas and, in particular, to phased array antennas. Still more particularly, the present disclosure relates to a phased array antenna having unit cells that are identical to each other.

2. Background

A phased array antenna is a group of antennas in which the relative phases of the respective waves sent to and from the antennas may be varied. The variant of the waves sent to and from the antennas is such that the effect of the radiation pattern of the antennas is reinforced in a desired direction and suppressed in undesired directions. In other words, one or more beams may be generated that may be pointed in or steered into different directions. A beam pointing in a transmit or receive phased array antenna is achieved by controlling the phasing timing of the transmitted or received signal from each antenna in the phased array antenna. The antennas in the phased array antenna may also be referred to as antenna elements.

The individual radiated waves are combined to form the constructive and destructive interference patterns of the array. A phased array antenna may be used to point one or more fixed beams or to scan one or more beams in azimuth, elevation, or both.

One of the advantages of phased array antennas is that these types of antenna designs are typically thinner than other types of antennas. For example, a phased array antenna may be manufactured having a shape that is thinner than a reflector antenna.

Reducing the size and/or weight of phased array antennas is often a desirable goal. For example, when a phased array antenna is used in an aircraft, a reduction in the size and weight of the phased array antenna may allow for maintaining or increasing performance of the aircraft. The performance that may be of interest may include, for example, without limitation, range, maximum speed, maximum altitude, and/or other types of performances.

In reducing the thickness of phased array antennas, the different electronic circuits are typically mounted in the same plane as the antenna elements. For example, if antenna elements are formed on one side of a plane or substrate, the electronic circuits may be formed on the other side of the substrate. Each antenna element is typically connected to one or more electronic circuits in a package.

The spacing of antenna elements is typically selected as at least about one half of a wavelength for the frequency being used. This selection is made to avoid a grating lobe. A grating lobe is a second main lobe in addition to the first main lobe that is in real space. It is desirable to avoid a second main lobe in transmitting electromagnetic waves in phased array antennas. As a result, a spacing of at least about one half of a wavelength is typically used.

As the frequency increases, the spacing between elements decreases. With currently available circuit designs and packaging for circuit designs, reducing the size of those electronic circuits may be challenging as the frequencies being used increases.

Therefore, it would be advantageous to have a method and apparatus for overcoming the problems described above.

SUMMARY

In one advantageous embodiment, an apparatus comprises a substrate, a plurality of antenna cells associated with the substrate, and a plurality of circuit systems associated with the substrate. The plurality of antenna cells have antenna elements in which each antenna cell in the plurality of antenna cells comprises a plurality of antenna elements in the antenna elements having a symmetric arrangement. The plurality of circuit systems is connected to the plurality of antenna cells and is configured to transmit electromagnetic waves using a portion of the plurality of antenna elements for each antenna cell.

In another advantageous embodiment, an apparatus comprises a substrate, a plurality of antenna cells associated with the substrate, and a plurality of circuit systems associated with the substrate. The plurality of antenna cells have antenna elements in which each antenna cell in the plurality of antenna cells comprises a plurality of antenna elements in the antenna elements having a symmetric arrangement. The plurality of circuit systems is connected to the plurality of antenna cells and is configured to receive electromagnetic waves using a portion of the plurality of antenna elements for each antenna cell.

In yet another advantageous embodiment, a method is provided for creating an antenna system. A configuration for a plurality of antenna cells is selected for an antenna in the antenna system. Each antenna cell in the plurality of antenna cells comprises a plurality of antenna elements having a symmetric arrangement. A portion of antenna elements in the plurality of antenna elements for each antenna cell in the plurality of antenna cells on a substrate is selected to transmit electromagnetic waves.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives, and advantages thereof, will best be understood by reference to the following detailed description of an advantageous embodiment of the present disclosure when read in conjunction with the accompanying drawings, wherein:

DETAILED DESCRIPTION

Figure 1:
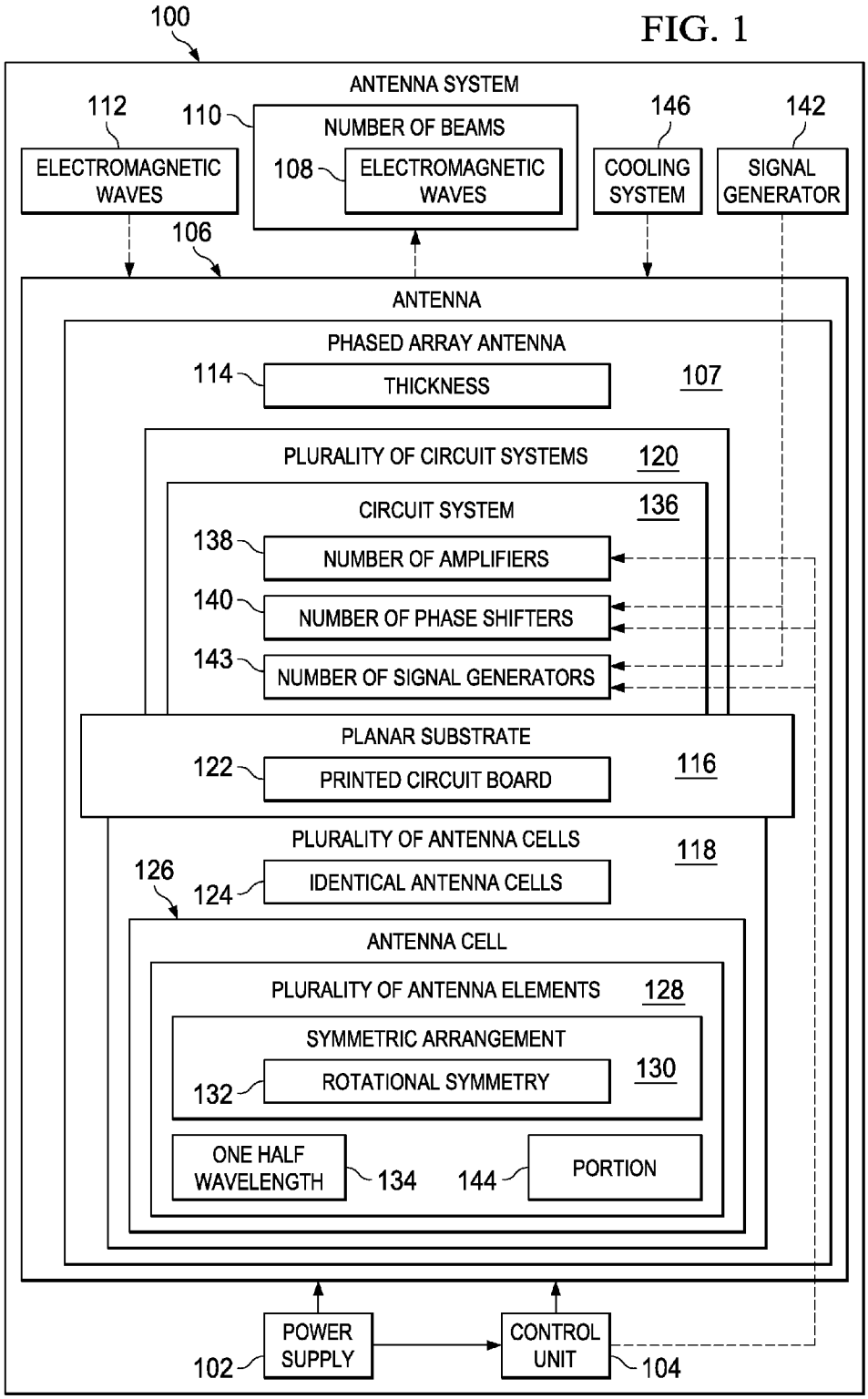
FIG. 1 is an illustration of an antenna system in accordance with an advantageous embodiment.

The different advantageous embodiments recognize and take into account a number of different considerations. For example, the different advantageous embodiments recognize and take into account that as the frequency of electromagnetic waves generated by a phased array antenna increases, the spacing between antenna elements is decreased to maintain a desired performance for the phased array antenna.

The different advantageous embodiments recognize and take into account that, with currently available circuits and the packaging for those circuits, the scaling of those circuits to be mounted on an opposite side of a substrate antenna element becomes more challenging.

The different advantageous embodiments recognize and take into account that currently, with millimeter wave frequencies, when spacing of at least about one half of a wavelength occurs, the surface area to mount the electronic circuits on the opposite side of an antenna element may require the electronic circuits to be mounted on a substantially perpendicular edge or side such that the thickness and/or width of the antenna increases. These electronic circuits typically take the form of integrated circuits, such as, for example, Monolithic Microwave Integrated Circuits (MMICs) and various passive radio frequency (RF) components in an electronics package.

This type of mounting is also referred to as a brick type mounting of electronic circuits. Further, this type of mounting of integrated circuits is in contrast to mounting the electronic circuits on a substrate in the plane of the antenna within the size of the antenna element cell to reduce the thickness. When these electronic circuits are mounted on either side of a planar substrate, this type of mounting is also referred to as tile type mounting. With tile type mounting, the thickness of the antenna decreases.

The different advantageous embodiments recognize and take into account that the brick type mounting of an integrated circuit to a printed circuit board may require more expensive interfaces and mounting techniques as compared to being able to mount the chip in a tiled manner.

Thus, the different advantageous embodiments provide a method and apparatus for an antenna. In one advantageous embodiment, an apparatus comprises a substrate, a plurality of antenna cells associated with the substrate, and a plurality of circuit systems associated with the substrate and connected to the plurality of antenna cells. In these illustrative examples, each antenna cell in the plurality of antenna cells comprises a plurality of antenna elements in the antenna elements having a symmetric arrangement. The plurality of circuit systems is configured to transmit electromagnetic waves using a portion of the plurality of antenna elements for each antenna cell in the plurality of antenna cells.

In another advantageous embodiment, the plurality of circuit systems is configured to receive electromagnetic waves using a portion of the plurality of antenna elements for each antenna cell in the plurality of antenna cells.

With reference now to FIG. 1, an illustration of an antenna system is depicted in accordance with an advantageous embodiment. In this illustrative example, antenna system 100 comprises power supply 102, control unit 104, and antenna 106. Antenna 106, in these illustrative examples, is an antenna array. In particular, antenna 106 takes the form of phased array antenna 107.

In this illustrative example, power supply 102 provides power to control unit 104 and antenna 106 to generate electromagnetic waves 108 that may be transmitted as number of beams 110. Further, antenna 106 also may receive electromagnetic waves 112 in addition to or in place of transmitting electromagnetic waves 108, depending on the configuration or mode of operation of antenna system 100.

In these illustrative examples, thickness 114 of antenna 106 may be reduced using the different advantageous embodiments. Further, as depicted, antenna 106 comprises planar substrate 116, plurality of antenna cells 118, and plurality of circuit systems 120. In particular, in these examples, planar substrate 116 has a tile type architecture.

In these illustrative examples, planar substrate 116 may be comprised of any material or number of materials that are configured to allow plurality of antenna cells 118 and plurality of circuit systems 120 to be associated with planar substrate 116.

A first component, such as plurality of antenna cells 118 or plurality of circuit systems 120, may be considered to be associated with a second component, such as planar substrate 116, by being secured to the second component, bonded to the second component, fastened to the second component, and/or connected to the second component in some other suitable manner. The first component also may be connected to the second component using a third component. The first component may also be considered to be associated with the second component by being formed as part of and/or an extension of the second component.

In these illustrative examples, planar substrate 116 takes the form of printed circuit board 122 in these examples. In other illustrative examples, planar substrate 116 may take the form of a semiconductor wafer, a ceramic substrate, an inorganic ceramic composition, a glass-ceramic composition, a film substrate, a metal and polymer substrate, and/or some other suitable type of substrate. As one illustrative example, planar substrate 116 may be a semiconductor wafer comprising silicon, silicon-germanium, and/or other suitable types of materials.

In these illustrative examples, in addition to being associated with planar substrate 116, plurality of antenna cells 118 and plurality of circuit systems 120 are connected to each other. In particular, plurality of circuit systems 120 are electrically connected to plurality of antenna cells 118.

In these illustrative examples, each circuit system in plurality of circuit systems 120 is a number of integrated circuits. A number, as used herein with reference to items, means one or more items. A number of integrated circuits means one or more integrated circuits. In these illustrative examples, the number of integrated circuits is in a single package.

Plurality of circuit systems 120 is configured to generate electromagnetic waves 108 that are transmitted as number of beams 110 in these illustrative examples. Additionally, electromagnetic waves 112 detected by plurality of antenna cells 118 may be received by plurality of circuit systems 120.

As illustrated, plurality of antenna cells 118 is identical antenna cells 124. In other words, each antenna cell in plurality of antenna cells 118 is substantially the same as any other antenna cell within plurality of antenna cells 118 in these examples. In particular, each antenna cell is designed to be the same as other antenna cells. However, differences between antenna cells may occur during manufacturing of the antenna cells. Plurality of antenna cells 118 should be substantially the same such that a desired level of performance occurs when using plurality of antenna cells 118.

In these examples, antenna cell 126 is an example of an antenna cell in plurality of antenna cells 118. Antenna cell 126 has plurality of antenna elements 128. As depicted, plurality of antenna elements 128 has symmetric arrangement 130.

In these illustrative examples, symmetric arrangement 130 has rotational symmetry 132. In other words, antenna cell 126, when rotated by a selected amount, has the same look as prior to being rotated. The number of antenna elements within plurality of antenna elements 128 may be any number of antenna elements that allows plurality of antenna elements 128 to have rotational symmetry 132. For example, the number of antenna elements within plurality of antenna elements 128 may be selected from one of three antenna elements, four antenna elements, seven antenna elements, or some other suitable number.

In these illustrative examples, plurality of antenna elements 128 is spaced apart from each other by at least about one half wavelength 134. One half wavelength 134 is one half the wavelength of electromagnetic waves 108 or electromagnetic waves 112 in these illustrative examples.

Each of plurality of circuit systems 120 is associated with a corresponding antenna cell in plurality of antenna cells 118. In other words, each antenna cell has a corresponding circuit system.

In these illustrative examples, circuit system 136 in plurality of circuit systems 120 corresponds to antenna cell 126. Circuit system 136 comprises number of amplifiers 138 and number of phase shifters 140. Of course, other circuits may be included in addition to, or in place of, the ones depicted in this particular example.

Number of amplifiers 138 is configured to amplify a signal received from signal generator 142. Signal generator 142, in these examples, is a modulation and demodulation (MODEM) system. Number of phase shifters 140 is configured to change the phase of a signal received from signal generator 142. In this manner, number of amplifiers 138 and number of phase shifters 140 are configured to adjust a signal received from signal generator 142 to transmit electromagnetic waves 108.

In these illustrative examples, plurality of circuit systems 120 transmits electromagnetic waves 108 as number of beams 110 using portion 144 of plurality of antenna elements 128 for each antenna cell. In other words, for example, not all of the antenna elements in plurality of antenna elements 128 are used in antenna cell 126 for transmitting electromagnetic waves 108 from antenna cell 126. For example, one, two, three, or some other number of antenna elements within plurality of antenna elements 128 may be used to transmit electromagnetic waves 108. The selection of which antenna elements are used in these illustrative examples is performed using a random selection. This type of selection also may be referred to as thinning.

In this manner, a circuit system is associated with an antenna cell, rather than an individual antenna element. In these illustrative examples, the desired spacing between antenna elements may be maintained through the selection of which antenna elements within a cell are considered active. An active antenna element is an antenna element that is used to transmit electromagnetic waves, while an inactive antenna element is an antenna element that is not used. In other words, an active antenna element is an antenna element that is in portion 144. An inactive element is an antenna element that is not in portion 144.

In these illustrative examples, the antenna elements are selected during the design of antenna 106. The circuit systems may then be connected only to antenna elements that are active and not connected to antenna elements that are not active. In some illustrative examples, switches may be included in the circuit system to select which antenna elements are active.

As depicted in these examples, antenna system 100 may include cooling system 146. The selection of portion 144 of plurality of antenna elements 128 allows convection cooling to be used for cooling system 146 when antenna 106 operates at higher frequencies as compared to currently existing processes that need to use liquid cooling when antenna 106 operates at these higher frequencies. In particular, with the selection of portion 144 as the active antenna elements, the power density caused by the power dissipation for the active antenna elements is reduced as compared to when all of plurality of antenna elements 128 is active. This reduction in power density increases the frequencies for operation of antenna 106 for which convection cooling may be used.

The illustration of antenna system 100 in FIG. 1 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in some illustrative examples, an additional antenna in addition to antenna 106 may be found in antenna system 100. The antenna cells in the additional antenna may have the same configuration or design as antenna 106 or may have a different configuration.

Additionally, in some illustrative examples, antenna system 100 may be a radar system. When antenna system 100 is a radar system, circuit system 136 may include number of signal generators 143. Number of signal generators 143 may be configured to generate signals for transmitting electromagnetic waves 108 in response to signals received from control unit 104. In these illustrative examples, number of signal generators 143 may take the form of monolithic microwave integrated circuits.

Figure 2:
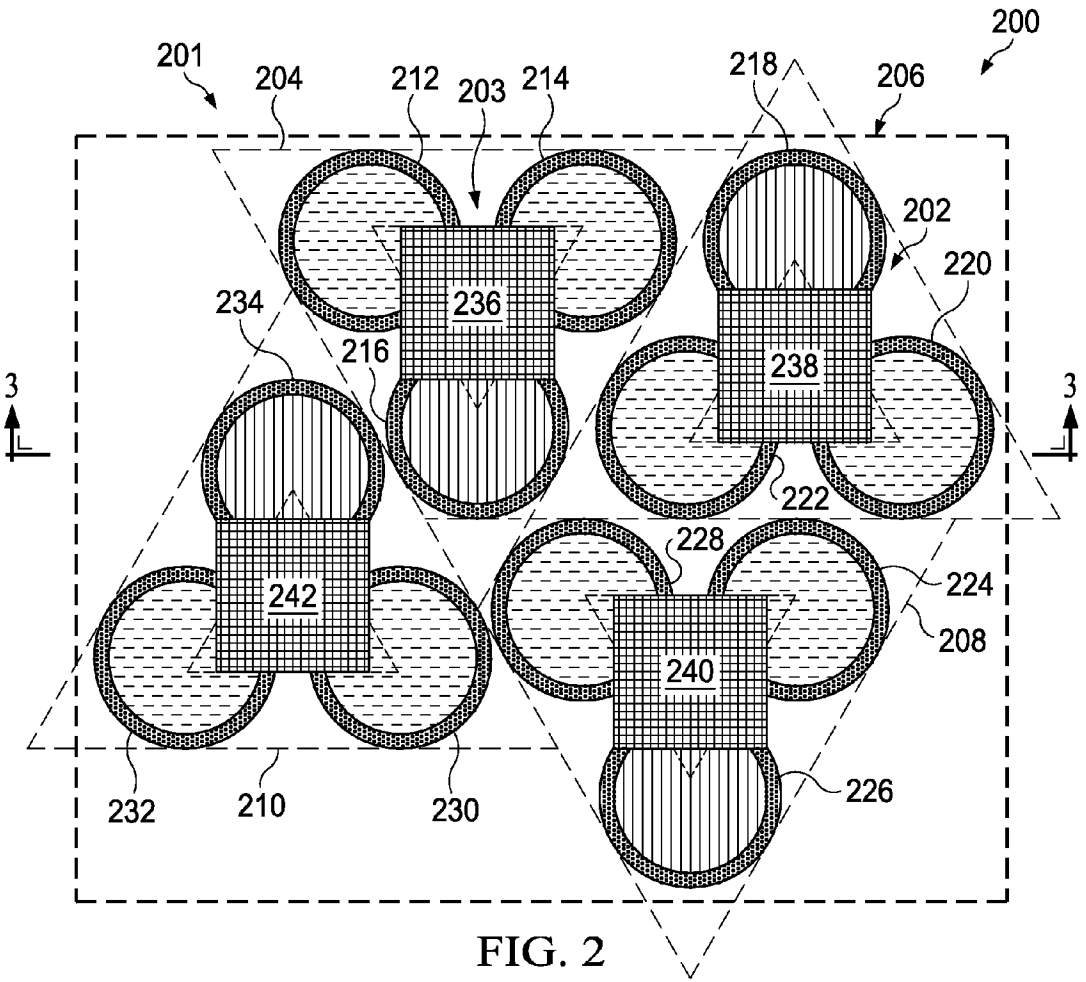
FIG. 2 is an illustration of an exposed phantom view of a portion of an antenna in accordance with an advantageous embodiment.

With reference now to FIG. 2, an illustration of an exposed phantom view of a portion of an antenna is depicted in accordance with an advantageous embodiment. In this illustrative example, antenna 200 is an example of one implementation for antenna 106 in FIG. 1. Antenna 200 is a phased array antenna in this example.

As depicted, antenna 200 includes planar substrate 201, plurality of antenna cells 202, and plurality of circuit systems 203. In this illustrative example, planar substrate 201 may take the form of a printed circuit board.

Plurality of antenna cells 202 and plurality of circuit systems 203 are associated with planar substrate 201. In particular, plurality of antenna cells 202 is implemented on planar substrate 201. Plurality of circuit systems 203 is mounted on planar substrate 201.

In this depicted example, plurality of antenna cells 202 includes antenna cells 204, 206, 208, and 210. Each of plurality of antenna cells 202 comprises a plurality of antenna elements. For example, antenna cell 204 comprises antenna elements 212, 214, and 216. Antenna cell 206 comprises antenna elements 218, 220, and 222. Antenna cell 208 comprises antenna elements 224, 226, and 228. Antenna cell 210 comprises antenna elements 230, 232, and 234.

As depicted, the antenna elements within each antenna cell in plurality of antenna cells 202 have a triangular arrangement. This triangular arrangement is a symmetrical arrangement having rotational symmetry. In other words, when rotated by any selected amount, such as about 120 degrees, each of plurality of antenna cells 202 may have the same geometrical appearance as prior to being rotated.

Each of plurality of antenna cells 202 is associated with a circuit system in plurality of circuit systems 203. For example, antenna cell 204 is associated with circuit system 236. Antenna cell 206 is associated with circuit system 238. Antenna cell 208 is associated with circuit system 240. Antenna cell 210 is associated with circuit system 242.

In this illustrative example, each circuit system in plurality of circuit systems 203 is configured to transmit electromagnetic waves using a portion of the antenna elements in the corresponding antenna cell in plurality of antenna cells 202. As depicted in this example, each of plurality of circuit systems 203 uses one antenna element in each of the antenna cells to transmit the electromagnetic waves. In particular, antenna elements 216, 218, 226, and 234 are used.

Antenna elements 216, 218, 226, and 234 that are used to transmit the electromagnetic waves are the active antenna elements for plurality of antenna cells 202. Antenna elements 212, 214, 220, 222, 224, 228, 230, and 232 are the inactive antenna elements for plurality of antenna cells 202.

Figure 3:
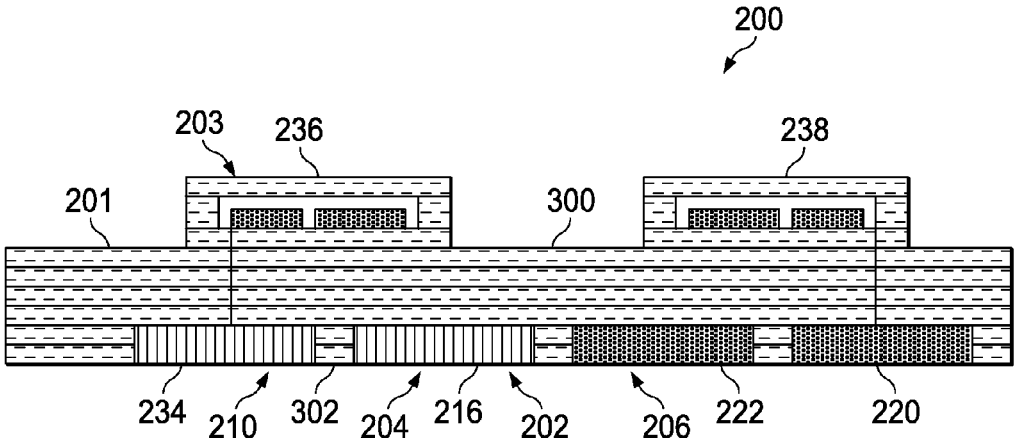
FIG. 3 is an illustration of a cross-sectional view of a portion of an antenna in accordance with an advantageous embodiment.

With reference now to FIG. 3, an illustration of a cross-sectional view of a portion of an antenna is depicted in accordance with an advantageous embodiment. In this illustrative example, a cross-sectional view of antenna 200 is depicted taken across lines 3-3 in FIG. 2.

As depicted, circuit system 236 and circuit system 238 are mounted onto side 300 of planar substrate 201. Antenna element 234 in antenna cell 210, antenna element 216 in antenna cell 204, and antenna elements 220 and 222 in antenna cell 206 are implemented on side 302 of planar substrate 201.

Figure 4:
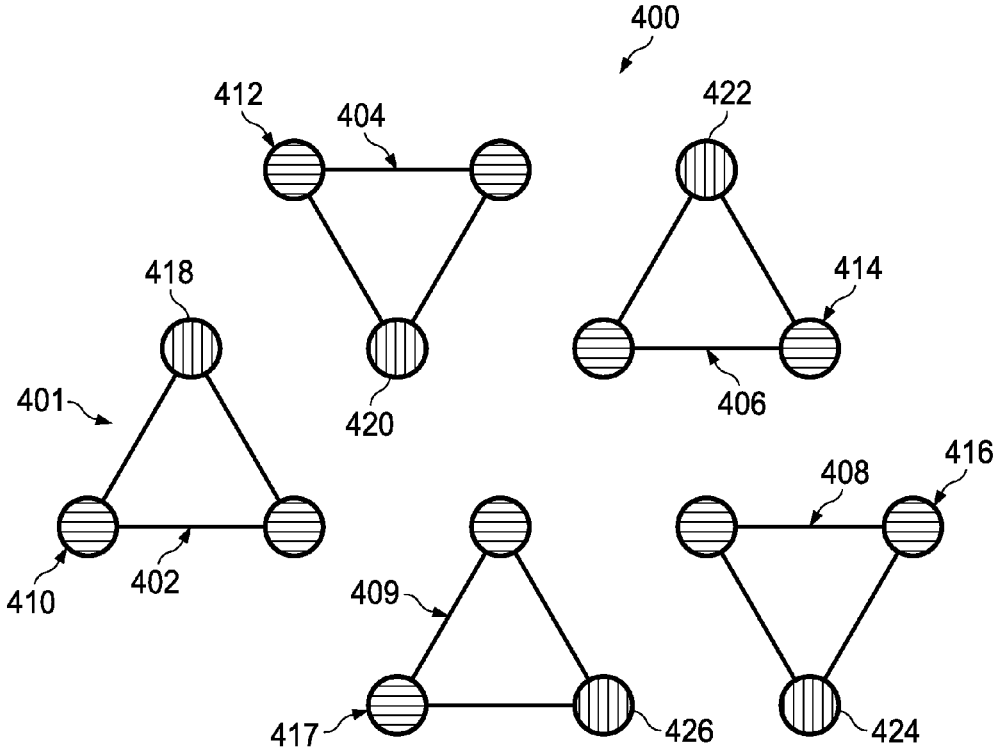
FIG. 4 is an illustration of a configuration of antenna cells for an antenna in accordance with an advantageous embodiment.

With reference now to FIG. 4, an illustration of a configuration of antenna cells for an antenna is depicted in accordance with an advantageous embodiment. In this illustrative example, configuration 400 of plurality of antenna cells 401 is an example of one implementation of a configuration for plurality of antenna cells 118 for antenna 106 in FIG. 1.

Plurality of antenna cells 401 is identical antenna cells in this example. As depicted, plurality of antenna cells 401 includes antenna cells 402, 404, 406, 408, and 409. Antenna cell 402 comprises plurality of antenna elements 410. Antenna cell 404 comprises plurality of antenna elements 412. Antenna cell 406 comprises plurality of antenna elements 414. Antenna cell 408 comprises plurality of antenna elements 416. Antenna cell 409 comprises plurality of antenna elements 417. Each of these pluralities of antenna elements has a symmetrical arrangement with rotational symmetry. In this example, the symmetrical arrangement is a triangular arrangement.

In this illustrative example, only a portion of each of the plurality of antenna elements in each of plurality of antenna cells 401 may be active. In other words, only a portion of each of the plurality of antenna elements in each of plurality of antenna cells 401 may be selected for transmitting electromagnetic waves. In this depicted example, antenna elements 418, 420, 422, 424, and 426 are active antenna elements. These active antenna elements are selected randomly in this illustrative example.

Figure 5:
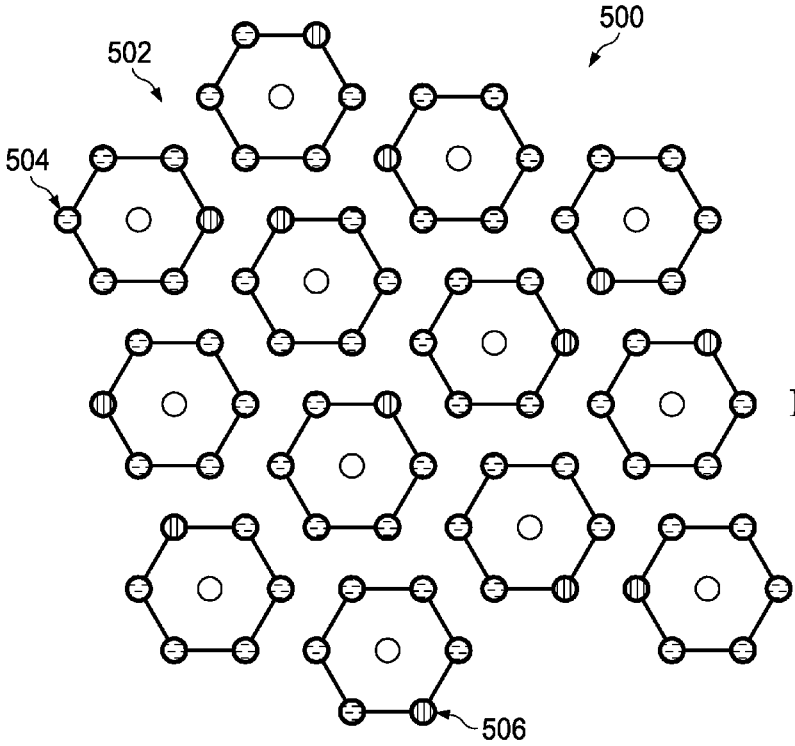
FIG. 5 is an illustration of a configuration of antenna cells for an antenna in accordance with an advantageous embodiment.

With reference now to FIG. 5, an illustration of a configuration of antenna cells for an antenna is depicted in accordance with an advantageous embodiment. In this illustrative example, configuration 500 of plurality of antenna cells 502 is an example of one implementation of a configuration for plurality of antenna cells 118 for antenna 106 in FIG. 1. Plurality of antenna cells 502 is identical antenna cells in this example.

In this illustrative example, plurality of antenna cells 502 has antenna elements 504. In particular, each of plurality of antenna cells 502 has seven antenna elements in antenna elements 504. These seven antenna elements for each antenna cell in plurality of antenna cells 502 have a symmetrical arrangement with rotational symmetry. In particular, the seven antenna elements for each antenna cell are arranged in a hexagonal shape. Six of the antenna elements are at the vertices of the hexagonal shape, while one of the antenna elements is in the center of the hexagonal shape.

In this illustrative example, one antenna element from each of the seven elements for each antenna cell in plurality of antenna cells 502 is randomly selected to be an active antenna element. These antenna elements that are selected form active antenna elements 506.

Figure 6:
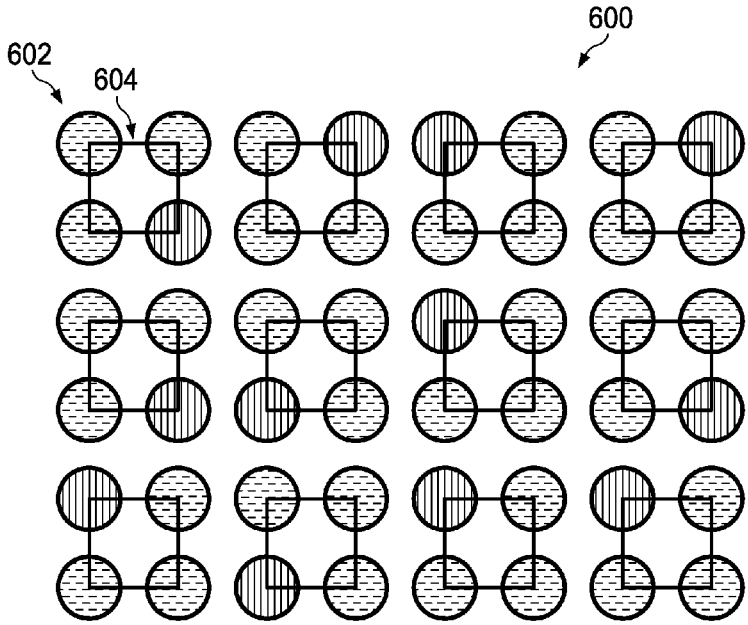
FIG. 6 is an illustration of a configuration of antenna cells for an antenna in accordance with an advantageous embodiment.

With reference now to FIG. 6, an illustration of a configuration of antenna cells for an antenna is depicted in accordance with an advantageous embodiment. In this illustrative example, configuration 600 of plurality of antenna cells 602 is an example of one implementation of a configuration for plurality of antenna cells 118 for antenna 106 in FIG. 1. Plurality of antenna cells 602 is identical antenna cells in this example.

As depicted, plurality of antenna cells 602 comprises antenna elements 604. In particular, each antenna cell in plurality of antenna cells 602 comprises four antenna elements. These four antenna elements for each antenna cell have a symmetrical arrangement with rotational symmetry. In this illustrative example, the symmetrical arrangement has a square shape.

Further, in this depicted example, one antenna element from the four antenna elements in each of plurality of antenna cells 602 is selected to be active to transmit electromagnetic waves. The antenna elements for transmitting the electromagnetic waves are selected randomly.

The illustrations of antenna 200 in FIGS. 2 and 3 and the configurations of pluralities of antenna cells 401, 502, and 602 in FIGS. 4, 5, and 6, respectively, are not meant to imply physical or architectural limitations to the manner in which different advantageous embodiments may be implemented. For example, other configurations of plurality of antenna elements in antenna cells may be implemented in the different advantageous embodiments.

Further, other shapes that provide rotational symmetry, in addition to the triangular shape, the hexagonal shape, and the square shape, may be used for the arrangement of antenna elements in an antenna cell.

Figure 7:
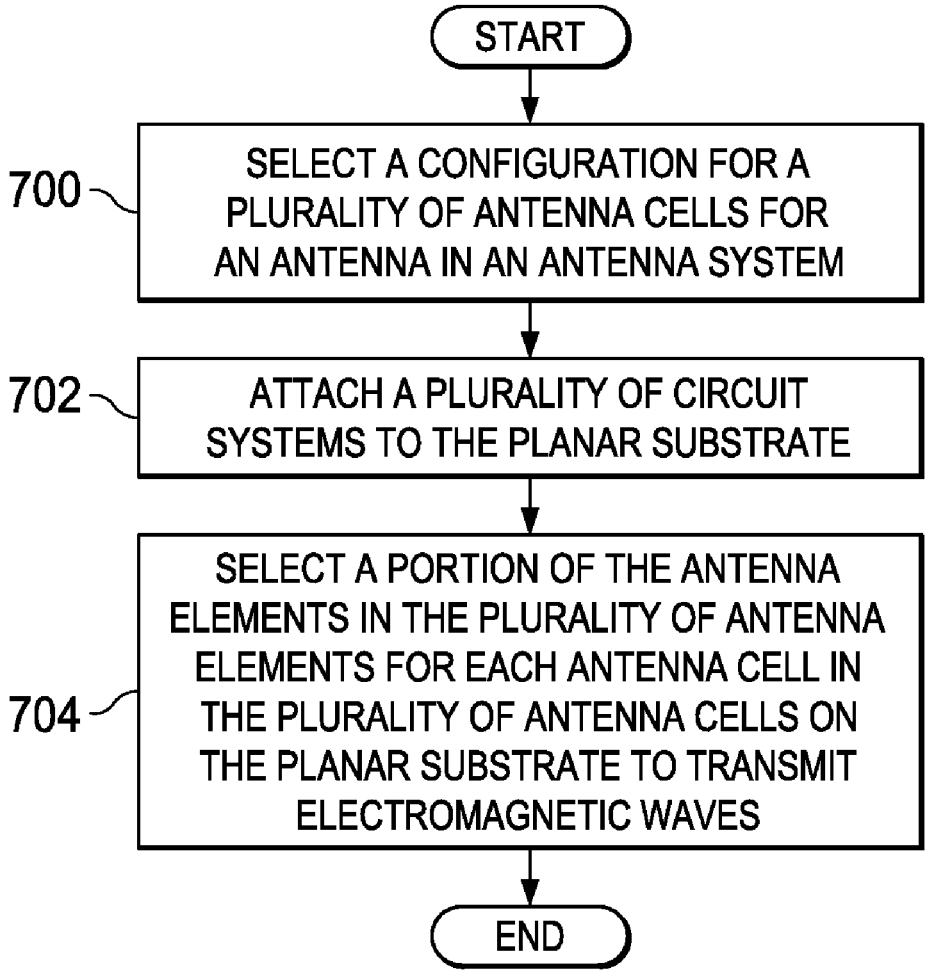
FIG. 7 is an illustration of a flowchart of a process for creating an antenna system in accordance with an advantageous embodiment.

With reference now to FIG. 7, an illustration of a flowchart of a process for creating an antenna system is depicted in accordance with an advantageous embodiment. The process illustrated in FIG. 7 may be implemented to create, for example, antenna system 100 in FIG. 1.

The process begins by selecting a configuration for a plurality of antenna cells for an antenna in an antenna system (operation 700). The antenna may be, for example, a phased array antenna. Each antenna cell in the plurality of antenna cells comprises a plurality of antenna elements having a symmetric arrangement. The symmetric arrangement has rotational symmetry. The symmetric arrangement may be, for example, without limitation, an arrangement having a triangular shape, a square shape, a hexagonal shape, or some other suitable type of shape. In operation 700, the configuration selected may be a configuration for attaching the plurality of antenna cells to a planar substrate.

Thereafter, the process attaches a plurality of circuit systems to the planar substrate (operation 702). Each circuit system in the plurality of circuit systems is associated with each antenna cell in the plurality of antenna cells. Further, the plurality of circuit systems is configured to transmit electromagnetic waves.

The process then selects a portion of the antenna elements in the plurality of antenna elements for each antenna cell in the plurality of antenna cells on the planar substrate for transmitting the electromagnetic waves (operation 704), with the process terminating thereafter. In operation 704, the portion of the antenna elements selected are active antenna elements. Further, this portion of antenna elements is selected randomly in operation 704.

The flowchart and block diagrams in the different depicted embodiments illustrate the architecture, functionality, and operation of some possible implementations of apparatus and methods in different advantageous embodiments. In this regard, each block in the flowchart or block diagrams may represent a module, segment, function, and/or a portion of an operation or step. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

Thus, the different advantageous embodiments provide a method and apparatus for an antenna. In one advantageous embodiment, an apparatus comprises a planar substrate, a plurality of antenna cells associated with the planar substrate, and a plurality of circuit systems associated with the planar substrate and connected to the plurality of antenna cells. In these illustrative examples, each antenna cell in the plurality of antenna cells comprises a plurality of antenna elements in the antenna elements having a symmetric arrangement. The plurality of circuit systems is configured to transmit electromagnetic waves using a portion of the plurality of antenna elements for each antenna cell in the plurality of antenna cells.

The description of the different advantageous embodiments has been presented for purposes of illustration and description and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a substrate;

a plurality of antenna cells associated with the substrate, wherein the plurality of antenna cells have antenna elements in which each antenna cell in the plurality of antenna cells comprises a plurality of antenna elements in the antenna elements having a symmetric arrangement; and a plurality of circuit systems associated with the substrate, connected to the plurality of antenna cells, and configured to transmit electromagnetic waves using a portion of the plurality of antenna elements for the each antenna cell;

wherein each of the plurality of circuit systems is associated with a corresponding antenna cell;

wherein the portion of the plurality of antenna elements for the corresponding antenna cell is selected by a corresponding circuit system of the plurality of circuit systems configured to select a number of portions of the plurality of antenna elements.

2. The apparatus of claim 1, wherein the substrate, the plurality of antenna cells, and the plurality of circuit systems form an antenna and further comprising:

a control unit connected to the antenna and configured to control a direction in which the electromagnetic waves are transmitted from the antenna; and a power source connected to the antenna and the control unit and configured to provide power to the antenna and the control unit.

3. The apparatus of claim 1 further comprising:

a cooling system configured to cool the plurality of circuit systems.

4. The apparatus of claim 2, wherein the antenna is a phased array antenna.

5. The apparatus of claim 1, wherein the substrate is a planar substrate in the form of a printed circuit board.

6. The apparatus of claim 1, wherein each circuit system in the plurality of circuit systems connected to an antenna cell comprises:

a number of amplifiers configured to amplify a signal received from a signal generator; and a number of phase shifters configured to change a phase of the signal received from the signal generator, wherein the number of amplifiers and the number of phase shifters are configured to adjust the signal received from the signal generator to transmit the electromagnetic waves.

7. The apparatus of claim 1, wherein the plurality of circuit systems comprises a plurality of integrated circuits.

8. The apparatus of claim 1, wherein the portion of the plurality of antenna elements for the each antenna cell used for transmitting the electromagnetic waves is selected randomly.

9. The apparatus of claim 1, wherein the plurality of antenna elements is selected from one of three antenna elements and seven antenna elements and wherein the symmetric arrangement has a rotational symmetry.

10. The apparatus of claim 1, wherein the plurality of antenna elements has spacing of at least one half of a wavelength of the electromagnetic waves.

11. The apparatus of claim 1, wherein the electromagnetic waves have a frequency between about 1 gigahertz and about 100 gigahertz.

12. The apparatus of claim 1, wherein the symmetric arrangement has a rotational symmetry.

13. The apparatus of claim 1, wherein the substrate has one of a tile type architecture and a brick type architecture.

14. An apparatus comprising:

a substrate;

a plurality of antenna cells associated with the substrate, wherein the plurality of antenna cells have antenna elements in which each antenna cell in the plurality of antenna cells comprises a plurality of antenna elements in the antenna elements having a symmetric arrangement; and a plurality of circuit systems associated with the substrate, connected to the plurality of antenna cells, and configured to receive electromagnetic waves using a portion of the plurality of antenna elements for the each antenna cell;

wherein each of the plurality of circuit systems is associated with a corresponding antenna cell;

wherein the portion of the plurality of antenna elements for the corresponding antenna cell is selected by a corresponding circuit system of the plurality of circuit systems configured to select a number of portions of the plurality of antenna elements.

15. The apparatus of claim 14, wherein the substrate has one of a tile type architecture and a brick type architecture, wherein the plurality of antenna elements is either three antenna elements or seven antenna elements and wherein the symmetric arrangement has a rotational symmetry.

16. A method for creating an antenna system, the method comprising:

selecting a configuration for a plurality of antenna cells for an antenna in the antenna system, wherein each antenna cell in the plurality of antenna cells comprises a plurality of antenna elements having a symmetric arrangement, wherein each of the plurality of circuit systems is associated with a corresponding antenna cell, and wherein the portion of the plurality of antenna elements for the corresponding antenna cell is selected by a corresponding circuit system of the plurality of circuit systems configured to select a number of portions of the plurality of antenna elements; and selecting a portion of antenna elements in the plurality of antenna elements for the each antenna cell in the plurality of antenna cells on a substrate to transmit electromagnetic waves.

17. The method of claim 16 further comprising:

attaching a plurality of circuit systems to the substrate, wherein each circuit system in the plurality of circuit systems is associated with the each antenna cell in the plurality of antenna cells.

18. The method of claim 16, wherein the step of selecting the portion of the antenna elements in the plurality of antenna elements for the each antenna cell in the plurality of antenna cells on the substrate to transmit the electromagnetic waves comprises:

randomly selecting the portion of antenna elements in the plurality of antenna elements for the each antenna cell in the plurality of antenna cells on the substrate to transmit the electromagnetic waves.

19. The method of claim 17, wherein the substrate, the plurality of antenna cells, and the plurality of circuit systems form the antenna for the antenna system and further comprising:

controlling a direction in which the electromagnetic waves are transmitted using a control unit for the antenna system;

providing power to the antenna and the control unit using a power source.

20. The method of claim 17 further comprising:

cooling the plurality of circuit systems using a cooling system.

21. The method of claim 16, wherein the antenna is a phased array antenna.

22. The method of claim 16, wherein the substrate has one of a tile type architecture and a brick type architecture.

23. The method of claim 16, wherein the substrate is a planar substrate in the form of a printed circuit board.

24. The method of claim 17, wherein the each circuit system in the plurality of circuit systems associated with the each antenna cell comprises a number of amplifiers and a number of phase shifters in which the number of amplifiers and the number of phase shifters are configured to adjust a signal received from a signal generator to transmit the electromagnetic waves.

25. The method of claim 16, wherein the symmetric arrangement has a rotational symmetry.

* * * * *